US010472155B2

(12) United States Patent
Tanaka et al.

(10) Patent No.: US 10,472,155 B2
(45) Date of Patent: Nov. 12, 2019

(54) SYNTHETIC RESIN BOTTLE

(71) Applicants: Toshimasa Tanaka, Tokyo (JP); Hiroki Oguchi, Tokyo (JP)

(72) Inventors: Toshimasa Tanaka, Tokyo (JP); Hiroki Oguchi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 107 days.

(21) Appl. No.: 15/127,282

(22) PCT Filed: Mar. 2, 2015

(86) PCT No.: PCT/JP2015/001088
§ 371 (c)(1),
(2) Date: Sep. 19, 2016

(87) PCT Pub. No.: WO2015/166619
PCT Pub. Date: Nov. 5, 2015

(65) Prior Publication Data

US 2017/0137199 A1 May 18, 2017

(30) Foreign Application Priority Data

Apr. 30, 2014 (JP) ..... 2014-093986

(51) Int. Cl.
*B65D 79/00* (2006.01)
*B65D 1/02* (2006.01)
(Continued)

(52) U.S. Cl.
CPC ..... *B65D 79/005* (2013.01); *B65D 1/023* (2013.01); *B65D 1/0207* (2013.01);
(Continued)

(58) Field of Classification Search
CPC .... B65D 79/005; B65D 1/0207; B65D 1/023; B65D 1/0276; B65D 1/0284; B65D 1/44;
(Continued)

(56) References Cited

U.S. PATENT DOCUMENTS

2010/0163513 A1 7/2010 Pedmo
2010/0219152 A1* 9/2010 Derrien ..... B65D 1/0276 215/374

(Continued)

FOREIGN PATENT DOCUMENTS

EP 2 962 947 A1 1/2016
JP 2010-535137 A 11/2010

(Continued)

OTHER PUBLICATIONS

Jun. 21, 2017 Office Action issued in Australian Patent Application No. 2015254809.

(Continued)

*Primary Examiner* — James N Smalley
*Assistant Examiner* — Madison L Poos
(74) *Attorney, Agent, or Firm* — Oliff PLC

(57) ABSTRACT

A synthetic resin bottle, wherein a bottom includes: an annular-shaped peripheral portion; a protruding ridge disposed radially inward from the peripheral portion and configured to serve as a ground contacting portion of the bottle by protruding downward from the peripheral portion and configured, when deformed under reduced pressure, to make the peripheral portion serve as the ground contacting portion by displaced toward an inside of the bottle (upward); and a depressed recess located radially inward from the protruding ridge and depressed toward the inside of the bottle. The peripheral portion has an outer diameter dimension less than that of a lower end portion of the trunk, or a plurality of radiately extending groove portions is arranged side by side
(Continued)

A-A section at an equal interval in the circumferential direction in the peripheral portion.

7 Claims, 3 Drawing Sheets

(51) Int. Cl.
*B65D 1/44* (2006.01)
*B65D 41/00* (2006.01)

(52) U.S. Cl.
CPC ..... *B65D 1/0276* (2013.01); *B65D 1/0284* (2013.01); *B65D 1/44* (2013.01); *B65D 41/00* (2013.01); *B65D 2501/0036* (2013.01)

(58) Field of Classification Search
CPC ..... B65D 41/00; B65D 2501/0036; B65D 1/0261
USPC ..... 215/372
See application file for complete search history.

(56) References Cited

U.S. PATENT DOCUMENTS

| | | | | |
|---|---|---|---|---|
| 2010/0297375 | A1* | 11/2010 | Protais | B65D 1/0284 428/36.92 |
| 2012/0181246 | A1 | 7/2012 | Ross et al. | |
| 2012/0248060 | A1 | 10/2012 | Saito et al. | |
| 2013/0087954 | A1* | 4/2013 | Tsuchiya | B29C 49/185 264/531 |
| 2013/0312368 | A1 | 11/2013 | Denner et al. | |
| 2015/0367979 | A1* | 12/2015 | Tanaka | B65D 1/0284 215/374 |

FOREIGN PATENT DOCUMENTS

| | | | |
|---|---|---|---|
| JP | 4700728 | B2 | 6/2011 |
| JP | 2012-513943 | A | 6/2012 |
| JP | 2014-5080 | A | 1/2014 |
| WO | 2010/061758 | A1 | 6/2010 |
| WO | 2013/178905 | A1 | 12/2013 |
| WO | 2014/036516 | A1 | 3/2014 |
| WO | 2014/132313 | A1 | 9/2014 |

OTHER PUBLICATIONS

Aug. 17, 2017 Extended Search Report issued in European Patent Application No. 15785660.0.
Nov. 1, 2016 International Preliminary Report on Patentability issued in International Patent Application No. PCT/JP2015/001088.
Oct. 26, 2017 Office Action issued in Canadian Patent Application No. 2,945,933.
May 26, 2015 International Search Report issued in International Patent Application No. PCT/JP2015/001088.
Nov. 27, 2018 Office Action issued in Japanese Patent Application No. 2016-515845.
Jun. 18, 2019 Office Action issued in Japanese Patent Application No. 2016-515845.

* cited by examiner

A-A section

SYNTHETIC RESIN BOTTLE

TECHNICAL FIELD

The present invention relates to a synthetic resin bottle, especially, to a synthetic resin bottle including a trunk that has good shape retainability and a bottom that, when an inside of the bottle is brought to a reduced pressure state, is displaced toward the inside direction to absorb the reduced pressure.

BACKGROUND

To fill a content medium, such as a juice beverage and tea, into a synthetic resin (e.g., polyethylene terephthalate) bottle, it has been customary to employ a so-called hot filling method of filling the content medium at a temperature of, for example, approximately 90° into the bottle, immediately followed by sealing the bottle with a cap, for sterilization of the contents and the bottle. Since the hot filling method involves cooling of the bottle after sealed, the inside of the bottle is brought to a significant reduced pressure state, and measures, such as providing the trunk with an area (so-called a reduced pressure absorbing panel) that is easily deformable or by allowing the bottom to be displaced toward the inside direction of the bottle (e.g., refer to Patent Literature 1), are taken to prevent the appearance of the bottle from undergoing unsightly deformation. Imparting the bottom with a reduced pressure absorption function as in Patent Literature 1 provides the following advantages. That is to say, design flexibility is enhanced because there is no need to provide the reduced pressure absorbing panel in the trunk, which attracts attention as the bottle appearance. Moreover, since there is no need for such a deformable reduced pressure absorbing panel, the trunk maintains its surface rigidity and has good shape retainability.

CITATION LIST

Patent Literature

PTL1: WO2010061758A1

SUMMARY

Technical Problem

A manufacturing process of a bottle used for foods or the like, the representative of which is a so-called PET bottle, employs transfer devices used to transfer the bottle to the subsequent process after the process of filling the content medium, and examples of the transfer devices may include a shooter, which guides the bottle in a manner such that the bottom of the bottle is freely slidable thereon, and a container, which holds the bottom of the bottle.

However, in such a structure as in Patent Literature 1 that imparts the bottom with the reduced pressure absorption function, due to, for example, slight differences in thickness of various portions of the bottle, hot filling the content medium might cause an outer circumference of the bottom to undergo unsightly deformation as a result of reduced pressure absorption and displacement of the bottom, and the outer diameter might exceed the maximum diameter defined in design. When the outer diameter of the bottom of the bottle exceeds the defined maximum diameter, the bottom of the bottle might be a cause of troubles by, for example, being caught in the shooter or the container, in the manufacturing process.

The present disclosure is to solve the above problem, and the present disclosure is to provide a synthetic resin bottle, with the structure in which the bottom is imparted with the reduced pressure absorption function, that prevents the bottom from being deformed and exceeding the defined maximum diameter after the content medium is hot filled.

Solution to Problem

One of aspects of the present disclosure resides in a synthetic resin bottle including a mouth from which a content medium is dispensed, a shoulder, a trunk, and a bottom, all of which are integrally formed in the stated order, the bottom being configured to be displaced toward an inside direction of the synthetic resin bottle under a reduced pressure generated in the inside, thereby exhibiting a reduced pressure absorption function. The bottom includes: an annular-shaped peripheral portion; a protruding ridge disposed radially inward from the peripheral portion and configured to serve as a ground contacting portion of the synthetic resin bottle by protruding downward from the peripheral portion and also configured, when being deformed under the reduced pressure, to make the peripheral portion serve as the ground contacting portion by being displaced toward an inside of the synthetic resin bottle; and a depressed recess located radially inward from the protruding ridge and depressed toward the inside of the synthetic resin bottle. The peripheral portion has an outer diameter dimension that is less than an outer diameter dimension of a lower end portion of the trunk.

In a preferred embodiment of the above aspect, a plurality of radiately extending groove portions is arranged side by side at an equal interval in a circumferential direction in the peripheral portion.

In another preferred embodiment of the above aspect, the groove portions each have a shape that is tapered radially inward.

Another aspect of the present disclosure resides in a synthetic resin bottle including a mouth from which a content medium is dispensed, a shoulder, a trunk, and a bottom, all of which are integrally formed in the stated order, the bottom being configured to be displaced toward an inside direction of the synthetic resin bottle under a reduced pressure generated in the inside, thereby exhibiting a reduced pressure absorption function. The bottom includes: an annular-shaped peripheral portion; a protruding ridge disposed radially inward from the peripheral portion and configured to serve as a ground contacting portion of the synthetic resin bottle by protruding downward from the peripheral portion and also configured, when being deformed under the reduced pressure, to make the peripheral portion serve as the ground contacting portion by being displaced toward an inside of the synthetic resin bottle; and a depressed recess located radially inward from the protruding ridge and depressed toward the inside of the synthetic resin bottle. A plurality of radiately extending groove portions is arranged side by side at an equal interval in a circumferential direction in the peripheral portion.

In a preferred embodiment of the above aspect, the groove portions each have a shape that is tapered radially inward.

In another preferred embodiment of the above aspect, the peripheral portion has an outer diameter dimension that is less than an outer diameter dimension of a lower end portion of the trunk.

Advantageous Effects

According to the present disclosure, the peripheral portion of the bottom of the bottle has the outer diameter dimension that is less than the outer diameter dimension of the lower end portion of the trunk, and a step is defined between the lower end portion of the trunk and the peripheral portion. Accordingly, even when the outer circumference of the bottom is deformed into an unsightly shape after the content medium is hot filled, the deformation stays within the step defined between the lower end portion of the trunk and the peripheral portion, and the outer diameter of the bottom is prevented from exceeding the maximum diameter defined for the synthetic resin bottle. Furthermore, due to a rib-like effect of the step, behavior of radially outward deformation of the peripheral portion is prevented. Consequently, in a manufacturing process of the synthetic resin bottle, troubles that occur during transfer due to the outer diameter of the bottom of the bottle exceeding the defined maximum diameter are prevented.

Moreover, according to the present disclosure, with the plurality of radiately extending groove portions arranged side by side at an equal interval in the circumferential direction in the peripheral portion in the above structure, stress focused on the groove portions is distributed evenly throughout the circumferential direction, and imbalance between more deformable portions and less deformable portions is avoided. Accordingly, unsightly deformation of the outer circumference of the bottom is prevented, and it is further ensured that the outer diameter of the bottom is prevented from exceeding the maximum diameter defined for the synthetic resin bottle.

Moreover, according to the present disclosure, with the groove portions each having a shape that is tapered radially inward, the stress is focused on the groove portions more effectively, and accordingly, the bottom is deformed more easily, and the reduced pressure absorption effect and the aforementioned effect are further enhanced.

Moreover, according to the present disclosure, with the plurality of radiately extending groove portions arranged side by side at an equal interval in the circumferential direction in the peripheral portion, the stress focused on the groove portions is distributed evenly throughout the circumferential direction, and imbalance between more deformable portions and less deformable portions is avoided. This prevents unsightly deformation of the outer circumference of the bottom. Consequently, in a manufacturing process of the synthetic resin bottle, troubles that occur during transfer due to unsightly deformation of the outer diameter of the bottom of the bottle are prevented.

Moreover, according to the present disclosure, with the groove portions each having a shape that is tapered radially inward in the aforementioned structure, the stress is focused on the groove portions more effectively, and accordingly, the bottom is deformed more easily, and the reduced pressure absorption effect and the aforementioned effect are further enhanced.

Moreover, according to the present disclosure, the peripheral portion of the bottom of the bottle has the outer diameter dimension that is less than the outer diameter dimension of the lower end portion of the trunk, and the step is defined between the lower end portion of the trunk and the peripheral portion. Accordingly, even when the outer circumference of the bottom is deformed into an unsightly shape after the content medium is hot filled, the deformation stays within the step defined between the lower end portion of the trunk and the peripheral portion, and the outer diameter of the bottom is prevented from exceeding the maximum diameter defined for the synthetic resin bottle. Furthermore, due to the rib-like effect of the step, behavior of radially outward deformation of the peripheral portion is prevented. Consequently, in a manufacturing process of the synthetic resin bottle, troubles that occur during transfer due to the outer diameter of the bottom of the bottle exceeding the defined maximum diameter are prevented.

DETAILED DESCRIPTION

Some embodiments of the present disclosure will be described in more detail below with reference to the drawings.

Figure 1:
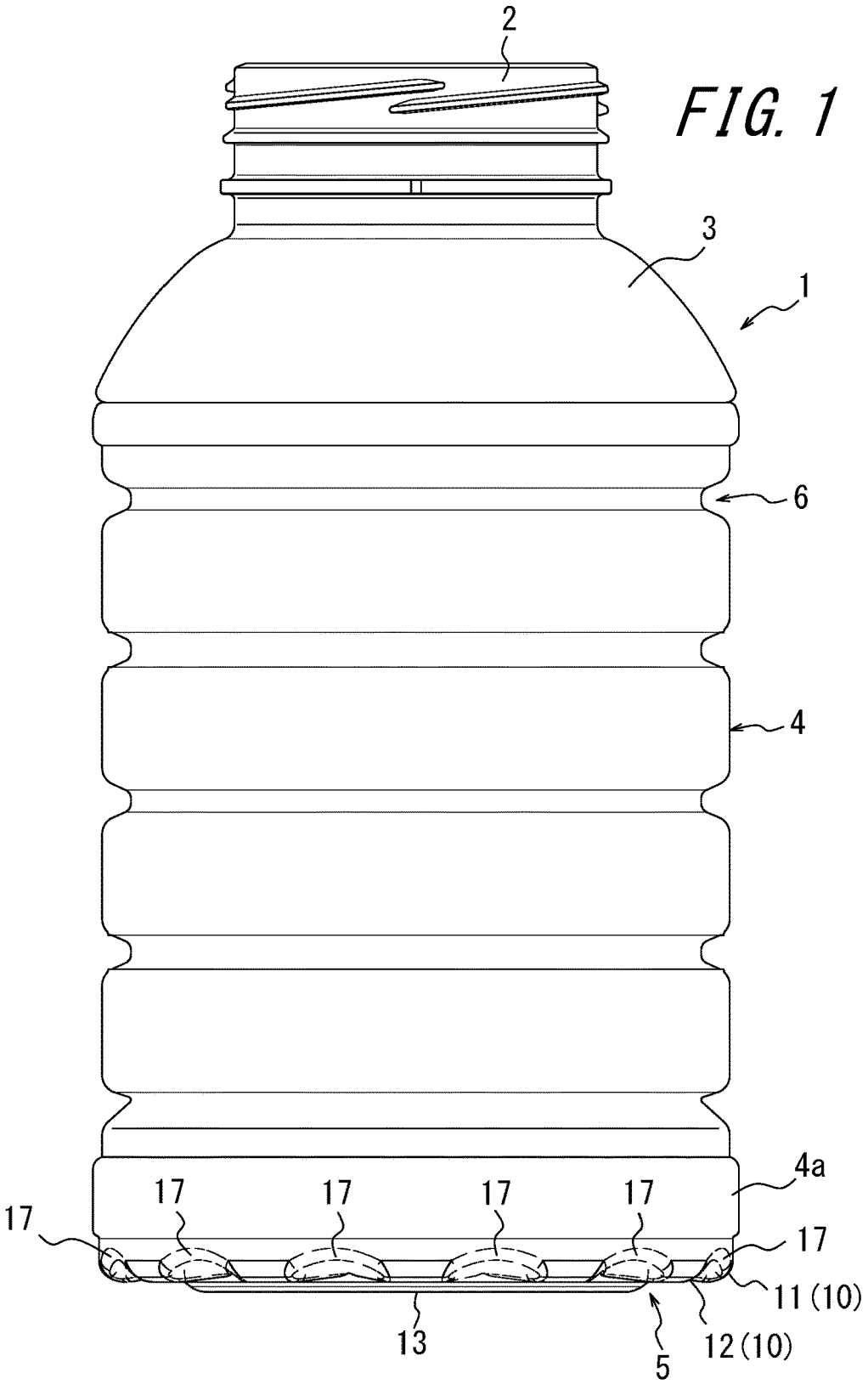
FIG. 1 is a side view of an embodiment of a synthetic resin bottle according to the present disclosure.
Figure 2:
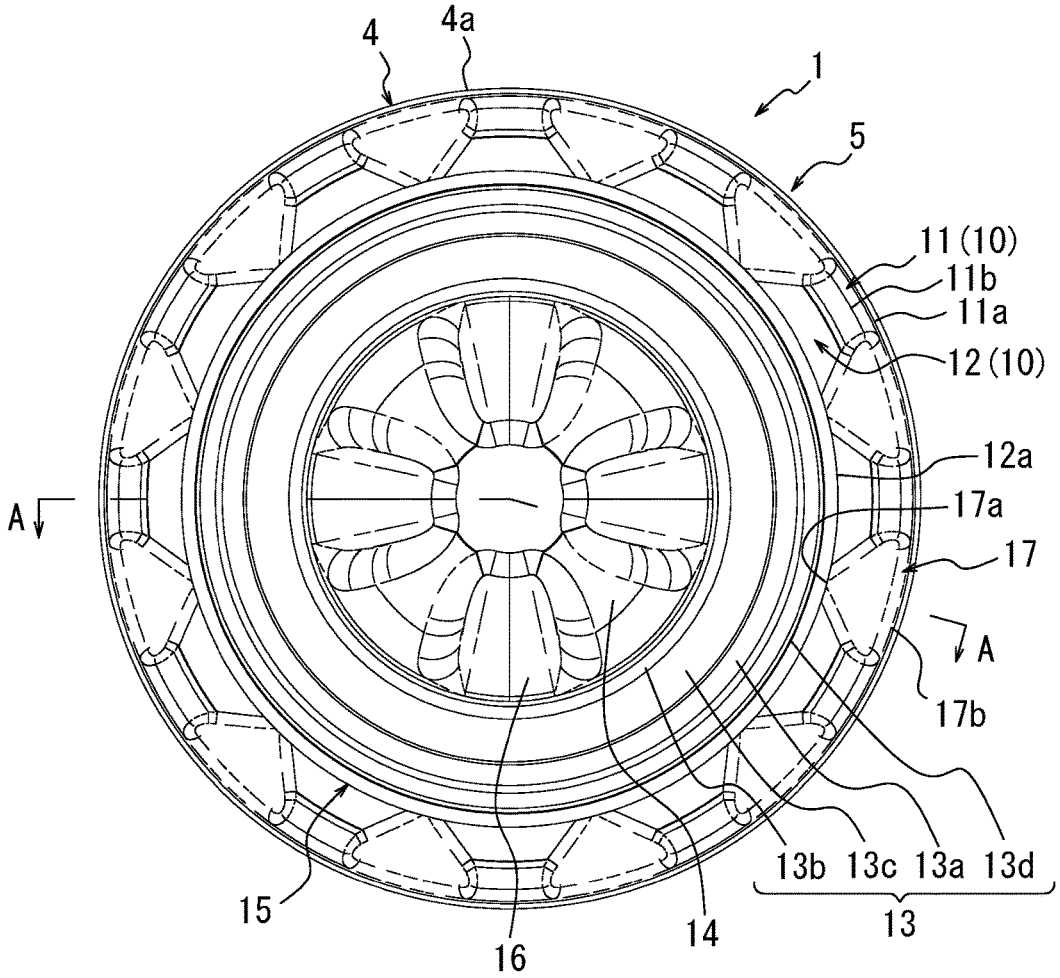
FIG. 2 is a bottom view of a bottle illustrated in FIG. 1.
Figure 3:
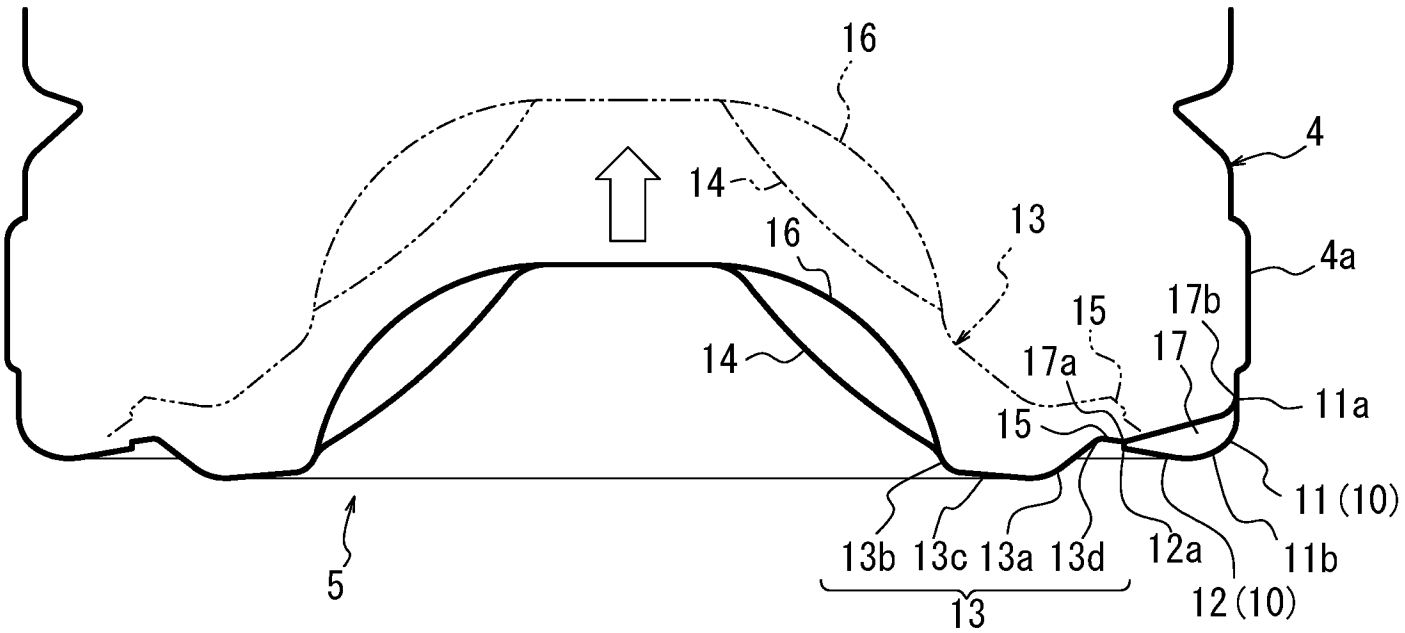
FIG. 3 is a partially enlarged sectional view of the vicinity of a bottom of a bottle illustrated in FIG. 1 that is taken along a line A-A in FIG. 2.

FIG. 1 is a side view illustrating an embodiment of a synthetic resin bottle according to the present disclosure, FIG. 2 is a bottom view of a bottle illustrated in FIG. 1 that is taken along a line A-A in FIG. 2, and FIG. 3 is a partially enlarged sectional view of the vicinity of a bottom of a bottle illustrated in FIG. 1. A two-dot chain line illustrated in FIG. 3 indicates an example of a state where the bottom is displaced upward when absorbing a reduced pressure.

In the figures, reference numeral 1 denotes a synthetic resin bottle (hereinafter, simply referred to as the "bottle") according to one of embodiments of the present disclosure. The bottle 1 includes a cylindrical mouth 2 that is opened in an upper side thereof. The bottle 1 also includes a shoulder 3, a cylindrical trunk 4, and a bottom 5 that are integrally connected to the mouth 2. Inside the bottle 1, inner space is defined to contain a content medium.

The trunk 4 includes (in the present embodiment, a total of 5) peripheral grooves 6 extending annually in the circumferential direction. The peripheral grooves 6 help enhance the surface rigidity of the trunk 4 and impart good shape retainability to the trunk 4. The trunk 4 is also provided in a lower end portion thereof with an annular rib portion 4*a*. The rigidity (such as the surface rigidity and the buckling strength) of the trunk 4 may be enhanced by various other appropriate ways such as by providing the trunk 4 with longitudinal ribs for reinforcement.

The bottom 5 includes an annular-shaped peripheral portion 10 located radially outermost in the bottom 5. The peripheral portion 10 includes a heel wall portion 11 that is connected to a lower end edge of the trunk 4 and an annular-shaped outer circumferential bottom wall portion 12 that is located radially inward from the heel wall portion 11. The heel wall portion 11 includes an outer circumferential cylindrical portion 11*a* that is connected to the lower end edge of the trunk 4, that is to say, the lower end edge of the rib 4*a* and also includes a heel-shaped portion 11*b* that is connected to a lower end edge of the outer circumferential cylindrical portion 11*a*. The outer circumferential bottom wall portion 12 is connected to an inner circumferential edge of the heel-shaped portion 11*b*. The heel-shaped portion 11*b* is a curved portion that is provided continuously between the outer circumferential cylindrical portion 11*a* and the outer circumferential bottom wall portion 12 and that protrudes downward. The bottom 5 also includes a protruding ridge 13 disposed radially inward from the peripheral portion 10. The protruding ridge 13 protrudes downward from the peripheral portion 10. The protruding ridge 13 is configured to serve as a ground contact portion of the bottle 1 and also configured, when being deformed under a reduced pressure (during absorption of the reduced pressure), to impart the peripheral portion 10 (heel-shaped portion 11*b*) with the role of the ground contacting portion by being displaced toward the inner space of the bottle above a lower end of the peripheral portion 10. A depressed recess 14 is also disposed radially inward from the protruding ridge 13. The depressed recess 14 has a shape that is depressed toward the inner space of the bottle.

As illustrated in detail in FIG. 3, the outer circumferential bottom wall portion 12 in the present embodiment is formed in, for example, a flat shape and is inclined upward as it extends radially inward. In this respect, it is to be noted that hot filling makes the synthetic resin more likely to be softened due to the temperature of the content medium and also brings the inside of the bottle to a pressurized state due to the filling pressure, and that the resulting stress acting downward on the bottom 5 might places the bottom 5 at the risk of undergoing downwardly bulging deformation. However, by increasing an inclination angle of the outer circumferential bottom wall portion 12 with respect to the horizontal direction, the bulging deformation is effectively prevented. Additionally, although the inclination angle of the outer circumferential bottom wall portion 12 may be selected suitably in consideration of balance between the effect of preventing the bulging deformation of the bottom and the reduced pressure absorption function, the outer circumferential bottom wall portion 12 may extend along the horizontal direction without inclination depending on the type of the content medium and conditions of hot filling.

The protruding ridge 13 in the present embodiment includes an outer circumferential-side portion 13*a*, an inner circumferential-side portion 13*b*, and a flat-shaped toe portion 13*c* disposed between the outer circumferential-side portion 13*a* and the inner circumferential-side portion 13*b*, and thus, the protruding ridge 13 in its section has a substantially trapezoidal shape. The toe portion may be curved to have a U-shape. Although in the present embodiment the toe portion 13*c* is slightly inclined upward as it extends radially inward, the toe portion 13*c* may also extend in the horizontal direction.

In the present embodiment, a groove-shaped recess 15 is also formed between an inner circumferential end edge 12*a* of the outer circumferential bottom wall portion 12 and an outer circumferential end edge 13*d* of the protruding ridge 13. Forming the groove-shaped recess 15 facilitates the displacement of the bottom 5 and promotes smooth upward displacement. Furthermore, because the thickness of the bottom 5 is not necessarily uniform, when the bottom 5 is displaced upward, a portion of the bottom 5 that is more deformable is displaced more preferentially. Accordingly, the upward displacement of the bottom 5 proceeds while applying bending stress to a concave-convex portion that undergoes concave and convex deformation in the circumferential direction and that extends radiately. Hence, this radiately extending portion applied with bending stress, when advancing radially outward, might places the peripheral portion 10, which serves as the ground contacting portion, at the risk of undergoing deformation. However, when the groove-shaped recess 15 is formed, the groove-shaped recess 15 prevents the radiately extending portion applied with bending stress from advancing radially outward, and accordingly, prevents the deformation of the peripheral portion 10 effectively and allows the peripheral portion 10 to exert the role of the ground contacting portion of the bottle 1 in a stable manner. Additionally, depending on the type of the content medium and conditions of hot filling, the groove-shaped recess 15 may be omitted, and the outer circumferential bottom wall portion 12 may be directly connected to the protruding ridge 13.

The depressed recess 14 in the present embodiment has a sectional shape including a side portion that is curved to bulge toward the inner space and a top portion that extends flat in the horizontal direction. The depressed recess 14 also includes reinforcing ribs 16 that bulge toward the outside of the bottle 1 and that extend radiately (in the present embodiment, as illustrated in FIG. 2, a total of 4 reinforcing ribs 16 are arranged at an equal interval in the circumferential direction). The sectional shapes of the depressed recess 14 and the reinforcing ribs 16, the number of the reinforcing ribs 16, and the like may be appropriately changed.

In the present disclosure, the outer circumferential cylindrical portion 11*a* of the heel wall portion 11 that constitutes the outermost portion of the peripheral portion 10 of the bottom 5 has an outer diameter dimension that is less than an outer diameter dimension of the lower end portion of the trunk 4. In the illustrated example, the outer circumferential cylindrical portion 11*a* is formed in a stepped form that is depressed inward relative to the rib portion 4*a* provided in the lower end portion of the trunk 4. Based on, for example, results of experimentations conducted in advance, the height of the step defined between the outer circumferential surface of the outer circumferential cylindrical portion 11*a* and the outer circumferential surface of the rib portion 4*a* of the trunk 4 may be set to a value by which, even when the bottom 5 is displaced upward when absorbing a reduced pressure and causes the outer circumferential cylindrical portion 11*a* to deform, the outer diameter of the outer circumferential cylindrical portion 11*a*, after the deformation, does not exceeds the outer diameter of the rib portion, 4*a*, and a portion of the outer circumferential cylindrical portion 11*a* does not protrude radially outward from the outer circumferential surface of the rib portion 4*a*.

The peripheral portion 10 may be provided with a plurality of groove portions 17 that are each recessed toward the inner space. As illustrate in FIG. 2, the groove portions 17 are arranged radiately in the peripheral portion 10 and, in the present embodiment, (a total of 12 groove portions 17) are arranged side by side at an equal interval in the circumferential direction. When viewed from the bottom, the groove portions 17 each have a shape that is tapered radially inward, that is to say, a substantially triangular shape. As illustrated in FIG. 3, the groove portion 17, in the section taken in a middle portion thereof, includes an inner circumferential end edge 17*a* that is aligned with the inner circumferential end edge 12*a* of the outer circumferential bottom wall portion 12 and an outer circumferential end edge 17*b* that is aligned with the outer circumferential cylindrical portion 11*a* of the heel wall portion 11, and the groove portion 17 is inclined upward as the groove portion 17 extends radially outward.

Although in the present embodiment the groove portions 17 are connected to the groove-shaped recess 15, the groove portions 17 do not need to be connected to the groove-shaped recess 15. The shape of each groove portion 17 is not limited to the aforementioned substantially triangular shape and may be appropriately selected. For example, the shape of each groove portion 17 may be a substantially circular, an elliptical, an oblong, a rectangular, or a trapezoidal shape.

When the bottle 1 structured as above is filled with the content medium at a high temperature and is cooled after the mouth 2 is capped, the inside of the bottle 1 is placed under a reduced pressure state, and as illustrated by the two-dot chain line in FIG. 3, the bottom 5 is displaced upward toward the inner space of the bottle 1. Thus, the reduced pressure inside the bottle is absorbed, and the trunk 4 is prevented from being deformed.

As the bottom 5 is displaced upward toward the inner space of the bottle 1, the outer circumferential cylindrical portion 11*a* of the heel wall portion 11 of the bottom 5 is deformed. At this time, when the thickness of the bottle 1 is slightly non-uniform depending on various portions of the bottle 1, the outer circumferential cylindrical portion 11*a* might be deformed into an unsightly shape in the circumferential direction. However, since in the present disclosure the outer diameter dimension of the outer circumferential cylindrical portion 11*a* of the heel wall portion 11 that constitutes the outermost portion of the peripheral portion 10 of the bottom 5 is less than the outer diameter dimension of the lower end portion (the rib portion 4*a*) of the trunk 4, even when the upward displacement of the bottom 5 causes unsightly deformation of the outer circumferential cylindrical portion 11*a*, the outer circumferential cylindrical portion, after the deformation, is prevented from extending radially outward from the outer circumferential surface of the rib portion 4*a* of the trunk 4 and exceeding the maximum diameter defined for the bottle 1, that is to say, the maximum diameter that takes design tolerance into consideration. Furthermore, since the trunk 4 is shaped to include, in the lower end portion thereof, the rib portion 4*a* protruding radially outward relative to the outer circumferential cylindrical portion 11*a*, due to the rib-like effect of the step defined between the rib portion 4*a* and the outer circumferential cylindrical portion 11*a*, the outer circumferential cylindrical portion 11*a* is firmly prevented from being deformed radially outward. Accordingly, in a manufacturing process of the bottle 1, the outer diameter of the bottom 5 of the bottle 1, after being hot filled with the content medium, is prevented from exceeding the defined maximum diameter, and this in turn prevents troubles in, for example, the transfer process.

Moreover, when the plurality of radiately extending groove portions 17 is arranged side by side at an equal interval in the circumferential direction in the peripheral portion 10, the stress focused on the groove portions is distributed evenly throughout the circumferential direction, and it is further ensured that the outer circumferential cylindrical portion 11*a* is prevented from being deformed and exceeding the maximum diameter defined for the bottle 1. Especially when the groove portions 17 each have a shape that is tapered radially inward as the groove portions 17 in the present embodiment, the stress is focused on the groove portions 17 more effectively, and accordingly, the bottom 5 is deformed more easily, and the reduced pressure absorption effect and the aforementioned effect are further enhanced. Moreover, by deforming the entire bottom 5 evenly by providing the groove portions 17, the ground contact stability and the appearance of the bottle 1 are favorably maintained.

In the above embodiment, the outer diameter dimension of the peripheral portion 10 of the bottom 5 of the bottle 1 is less than the outer diameter dimension of the lower end portion of the trunk 4, and the plurality of radiately extending groove portions 17 is arranged side by side at an equal interval in the circumferential direction. However, the present disclosure is not limited to this embodiment, and the groove portions 17 do not need to be provided in the peripheral portion 10, although the outer diameter dimension of the peripheral portion 10 is less than the outer diameter dimension of the lower end portion of the trunk 4, or alternatively, the outer diameter dimension of the peripheral portion 10 may be the same or greater than the outer diameter dimension of the lower end portion of the trunk 4, although the plurality of radiately extending groove portions 17 is arranged side by side at an equal interval in the circumferential direction in the peripheral portion 10.

Moreover, although in the above embodiment the outer circumferential surface of the heel wall portion 11 that constitutes the outermost portion of the peripheral portion 10 of the bottom 5 is formed as the cylindrical-shaped outer circumferential cylindrical portion 11*a* that defines the step relative to the rib portion 4*a*, which is the lower end portion of the trunk 4, the present disclosure is not limited to this embodiment. The outer circumferential surface of the heel wall portion 11 may also be formed in a shape (e.g., a tapered shape) whose diameter is reduced as it extends downward from the lower end portion (the rib portion 4*a*) of the trunk 4 without defining any step.

INDUSTRIAL APPLICABILITY

The present disclosure provides a synthetic resin bottle, with a structure in which a bottom is imparted with a reduced pressure absorption function, that prevents the bottom from being deformed and exceeding the defined maximum diameter after the content medium is hot filled.

REFERENCE SIGNS LIST

1 Bottle
2 Mouth
3 Shoulder
4 Trunk
4*a* Rib portion
5 Bottom
6 Peripheral groove
10 Peripheral portion
11 Heel wall portion
11*a* Outer circumferential cylindrical portion of heel wall portion
11*b* Heel-shaped portion of heel wall portion
12 Outer circumferential bottom wall portion
12*a* Inner circumferential end edge of flat portion
13 Protruding ridge
13*a* Outer circumferential-side portion
13*b* Inner circumferential-side portion
13*c* Toe portion
13*d* Outer circumferential end edge of protruding ridge
14 Depressed recess
15 Groove-shaped recess
16 Reinforcing rib
17 Groove portion
17*a* Inner circumferential end edge of groove portion
17*b* Outer circumferential end edge of groove portion

The invention claimed is:

1. A synthetic resin bottle comprising:

a mouth from which a content medium is to be dispensed, a shoulder, a trunk, and a bottom, all of which are integrally formed in the stated order, the bottom being configured to be displaced toward an inside direction of the synthetic resin bottle under a reduced pressure generated in an inside of the synthetic resin bottle, the bottom including:

an annular-shaped peripheral portion having an outer diameter dimension less than an outer diameter dimension of a lower end portion of the trunk;

a protruding ridge disposed radially inward from the peripheral portion and protruding further away from the inside of the synthetic resin bottle than the peripheral portion such that the protruding ridge contacts a surface without having the peripheral portion contact the surface when the synthetic resin bottle is placed on the surface, the protruding ridge being configured to recede toward the inside of the synthetic resin bottle such that the peripheral portion contacts the surface without having the protruding ridge contact the surface when the reduced pressure is generated inside of the synthetic resin bottle and the synthetic resin bottle is placed on the surface; and a depressed recess located radially inward from the protruding ridge and depressed toward the inside of the synthetic resin bottle.

2. The synthetic resin bottle according to claim 1, wherein a plurality of radiately extending groove portions are arranged side by side at an equal interval in a circumferential direction in the peripheral portion.

3. The synthetic resin bottle according to claim 2, wherein the groove portions are each tapered radially inward.

4. A synthetic resin bottle comprising:

a mouth from which a content medium is to be dispensed, a shoulder, a trunk, and a bottom, all of which are integrally formed in the stated order, the bottom being configured to be displaced toward an inside direction of the synthetic resin bottle under a reduced pressure generated in an inside of the synthetic resin bottle, the bottom including:

an annular-shaped peripheral portion;

a protruding ridge disposed radially inward from the peripheral portion and protruding further away from the inside of the synthetic resin bottle than the peripheral portion such that the protruding ridge contacts a surface without having the peripheral portion contact the surface when the synthetic resin bottle is placed on the surface, the protruding ridge being configured to recede toward the inside of the synthetic resin bottle such that the peripheral portion contacts the surface without having the protruding ridge contact the surface when the reduced pressure is generated inside of the synthetic resin bottle and the synthetic resin bottle is placed on the surface;

a depressed recess located radially inward from the protruding ridge and depressed toward the inside of the synthetic resin bottle; and a plurality of radiately extending groove portions are arranged side by side at an equal interval in a circumferential direction in the peripheral portion.

5. The synthetic resin bottle according to claim 4, wherein the groove portions are each tapered radially inward.

6. The synthetic resin bottle according to claim 4, wherein the peripheral portion has an outer diameter dimension less than an outer diameter dimension of a lower end portion of the trunk.

7. The synthetic resin bottle according to claim 5, wherein the peripheral portion has an outer diameter dimension less than an outer diameter dimension of a lower end portion of the trunk.

* * * * *